US006402429B1

(12) United States Patent
James

(10) Patent No.: US 6,402,429 B1
(45) Date of Patent: Jun. 11, 2002

(54) BUOYANCY COMPENSATOR HARNESS SYSTEM

(75) Inventor: Joseph P. James, Lutz, FL (US)

(73) Assignee: Zeagle Systems, Inc.

( * ) Notice: Subject to any disclaimer, the term of this patent is extended or adjusted under 35 U.S.C. 154(b) by 0 days.

(21) Appl. No.: 09/378,072

(22) Filed: Aug. 20, 1999

(51) Int. Cl.[7] ..... B63C 11/00
(52) U.S. Cl. ..... 405/186; 441/96; 441/102
(58) Field of Search ..... 405/186; 441/96, 441/102

(56) References Cited

U.S. PATENT DOCUMENTS

| | | | | |
|---|---|---|---|---|
| 3,898,705 A | | 8/1975 | Schuler | 9/313 |
| 4,000,534 A | | 1/1977 | Cerniway et al. | 9/342 |
| 4,523,914 A | | 6/1985 | Faulconer et al. | 441/108 |
| 4,752,263 A | | 6/1988 | Pritchard et al. | 441/88 |
| 4,778,307 A | | 10/1988 | Faulconer | 405/186 |
| 4,810,134 A | | 3/1989 | Eaulconer et al. | 405/186 |
| 4,913,589 A | | 4/1990 | Faulconer et al. | 405/186 |
| 5,020,941 A | | 6/1991 | Bulen et al. | 405/186 |
| 5,346,419 A | | 9/1994 | Kaiser | 441/96 |
| 5,363,790 A | * | 11/1994 | Matsuoka | 405/186 |
| 6,120,213 A | * | 9/2000 | Stinton | 441/111 |

* cited by examiner

*Primary Examiner*—Sherman Basinger
(74) *Attorney, Agent, or Firm*—Holland & Knight LLP

(57) ABSTRACT

The invention comprises a buoyancy compensator for supporting an air cylinder to the back of a scuba diver. The buoyancy compensator comprises a vest to be worn about the diver's torso and an inflatable air bladder assembly interconnected to the vest by tank straps which rigidly secure the air cylinder of the vest in a backpack configuration. The inflatable bladder assembly comprises a horseshoe-shaped configuration positioned over the cylinder with the sides of the air bladder assembly being positioned along the opposing sides of the air cylinder so at to not obstruct the diver's view or freedom of movement. The vest of the buoyancy compensator comprises a back section, an adjustable torso section, adjustable shoulder strap sections connected to the adjustable torso section and adjustable left and right waistband sections. The vertical adjustment of the torso section relative to the vest allows the height of the buoyancy compensator to be easily adjusted.

13 Claims, 11 Drawing Sheets

BUOYANCY COMPENSATOR HARNESS SYSTEM

BACKGROUND OF THE INVENTION

1. Field of the Invention

This invention relates to buoyancy compensators for scuba divers. More particularly, this invention relates to buoyancy compensators comprising a vest fitted about the diver's torso for supporting an air cylinder and a bladder assembly connected to the vest for inflation with air from the air cylinder to achieve neutral buoyancy during diving.

2. Description of the Background Art

Presently, there exist many types of buoyancy compensators designed to allow a scuba diver to achieve neutral buoyancy during diving. The earliest types of buoyancy compensators consisted of an inflatable bladder positioned in a life vest to be slipped over the diver's head and to lay against the diver's chest. An oral inflation tube was provided to allow oral inflation of the buoyancy compensator by the scuba diver to achieve neutral buoyancy during diving. As illustrated in U.S. Pat. Nos. 3,898,705 and 4,000,534, the disclosures of which are hereby incorporated herein further improvements included providing a power inflator which inflated the bladder with air from the air cylinder. Unfortunately, life-vest styled buoyancy compensators tended to ride up the diver's chest and obstruct the diver's view and freedom of movement. To overcome this disadvantage, improved buoyancy compensators positioned the inflatable bladder in a backpack vest so that the vest, when inflated, would not obstruct the diver's view or freedom of movement (see U.S. Pat. No. 4,752,263, the disclosure of which is hereby incorporated herein).

As shown in U.S. Pat. Nos. 4523,914, 4,778,307 and 4,810,134, the disclosures of which are hereby incorporated herein, another approach to minimizing the obstruction of the diver's view and freedom of movement included constructing the bladder in an integral suit-vest configuration with the bladder extending smoothly throughout the front and back section of the vest. However, unlike backpack-styled buoyancy compensators, suit-vest configurations do not include a replaceable bladder that could be replaced in the event of damage or deterioration.

Backpack-styled buoyancy compensators have been widely accepted in the trade and have been further improved to include a separate vest for fitting about the diver's torso to support the air cylinder and a bladder assembly connected to the vest. U.S. Pat. No. 4,913,589, the disclosure of which is hereby incorporated herein, illustrates one specific backpack-styled buoyancy compensator. In another, such as the one manufactured by the assignee of this invention, the separate vest further includes a cummerbund for a more comfortable fitting about the diver's waist.

The foregoing buoyancy compensators were typically manufactured in limited sizes (e.g., small, medium, large and extra large). Adjustable shoulder and waist straps were provided to provide some adjustability. However, the vest was not otherwise adjustable to accommodate scuba divers with different physiques. Thus, a "large" size vest was forced to fit, for example, both a diver with a taller torso and a diver with a shorter torso, even though their physiques are significantly different. Hence, there existed a need in the market for a backpack-styled buoyancy compensator that included a vest that was adjustable for tall, medium and short-torso heights.

In satisfaction of this need, a buoyancy compensator with a detachable shoulder section was invented by the inventors of the same assignee of the subject invention. This buoyancy compensator with its detachable shoulder section is disclosed in U.S. Pat. No. 5,020,941, the disclosure of which is hereby incorporated herein. The invention as set forth in this patent disclosed a buoyancy compensator vest as comprising a back section which supports the air cylinder via the tank straps, a waistband section, having left and right side portions for removably fitting about the diver's waist, and a shoulder section having a horizontal portion and left and right shoulder sections for positioning over the diver's shoulders to then be connected to the left and right portions of the waistband section. The removability of the shoulder section from the back section allowed shoulder sections of different torso heights to be fitted to the back section so as to provide a comfortable and custom fit of the vest to the height of the diver's torso. For example, a diver having a tall torso height may be properly fitted with the vest by utilizing a shoulder length having a longer length. Conversely, a diver having a shorter torso height may be properly fitted with a vest by utilizing a vest having a shoulder section of a shorter length.

The foregoing buoyancy compensator with its detachable shoulder section has been widely commercialized throughout the scuba industry with substantial success. Unfortunately, as described above, the detachable shoulder section is the component of the compensator which accommodates for divers having taller or shorter torso lengths. However, because the shoulder section in its preferred embodiment comprises a one-piece design, the length of the shoulder straps are not independently adjustable relative to the shoulder section itself. Hence, while it readily accommodates for taller and shorter torso heights, it does not accommodate for large, medium or small chest sizes wherein longer or shorter shoulder straps, respectively, would be desirable to more comfortably fit over the diver's shoulders and down along the diver's chest. Hence, there presently exists a need in the industry for a backpack-styled buoyancy compensator having a vest that is adaptable to tall, medium and short torso lengths as well as to large, medium and small chest sizes.

Therefore, it is an object of this invention to provide an improvement which overcomes the aforementioned inadequacies of the prior art devices and provides an improvement which is a significant contribution to the advancement of the buoyancy compensator art.

Another object of this invention is to provide a buoyancy compensator having a vest that is adaptable to tall, medium and short torso lengths.

Another object of this invention is to provide a buoyancy compensator having a vest that is adaptable to large, medium and small chest sizes.

Another object of this invention is to provide a buoyancy compensator having a vest that is adaptable to tall, medium and short torso lengths as well as to large, medium and small chest sizes.

Another object of this invention is to provide a buoyancy compensator comprising a vest including left and right side portions, the vest further including a back section, a torso section, left and right shoulder sections and left and right waistband sections; means for adjustably connecting the torso section to the back section; means for adjustably connecting the shoulder sections to the torso section; and means for adjustably connecting the waistband sections to respective side portions of the back section.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a buoyancy compensator for supporting an air cylinder to the back of a scuba diver. More particularly, the buoyancy compensator of the invention comprises a vest to be worn about the diver's torso and an inflatable air bladder assembly interconnected to the vest by means of tank straps which rigidly secure the air cylinder to the vest in a backpack configuration. Preferably, the inflatable air bladder assembly comprises a horseshoe-shaped configuration positioned over the cylinder with the sides of the air bladder assembly being positioned along the opposing sides of the air cylinder so as to not obstruct the diver's view or freedom of movement.

The vest of the buoyancy compensator comprises a back section, an adjustable torso section, adjustable shoulder strap sections connected to the adjustable torso section and adjustable left and right waistband sections. More particularly, the adjustable torso section of the invention is vertically adjustable to the inside back of the vest. The vertical adjustment of the torso section relative to the vest allows the height of the buoyancy compensator to be easily adjusted. Increased vertical length is desirable for accommodating the physique of a scuba diver such that the buoyancy compensator can be easily fitted to scuba divers having taller or shorter torso heights. The adjustability of the strap sections to the torso section accommodates scuba divers having larger or smaller chest sizes such that the buoyancy compensator may be adjusted to easily fit over the diver's shoulders and down the diver's chest. Finally, the adjustability of waistband sections accommodates scuba divers having larger or smaller waist sizes such that the buoyancy compensator may be easily adjusted to fit scuba divers with larger or smaller waist sizes.

The adjustability of each of the sections of the buoyancy compensator of the invention achieves a one-size-fits-all buoyancy compensator such that a comfortable and custom fit of the buoyancy compensator to scuba divers of various physiques can be easily accomplished. The one-size-fits-all aspect of the buoyancy compensator of the invention allows easier manufacturing, distribution and retail sale to the scuba divers as there is no longer a need to manufacture, distribute or stock buoyancy compensators of many different sizes.

More specifically, the versatility of the adjustable sections of the buoyancy compensator of the invention allows the buoyancy compensator to be fitted to the scuba divers of various physiques that may differ from the typical "standard" sizes of small, medium, large and extra large. Specifically, the buoyancy compensator of the invention may be easily adjusted to fit a scuba diver having a tall and thin physique or to one that may have a tall yet more stocky physique. Thus, the versatility of the adjustable of the buoyancy compensator of the invention significantly improves the comfortability and accuracy of the fitting to the scuba diver.

An ancillary feature of the buoyancy compensator of the invention is the ability to mix or match different colored sections to provide a more aesthetically pleasing and marketable buoyancy compensator to the scuba diver. For example, the shoulder straps of one color may be combined with waistband sections of a different color and with a vest of still a third color.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
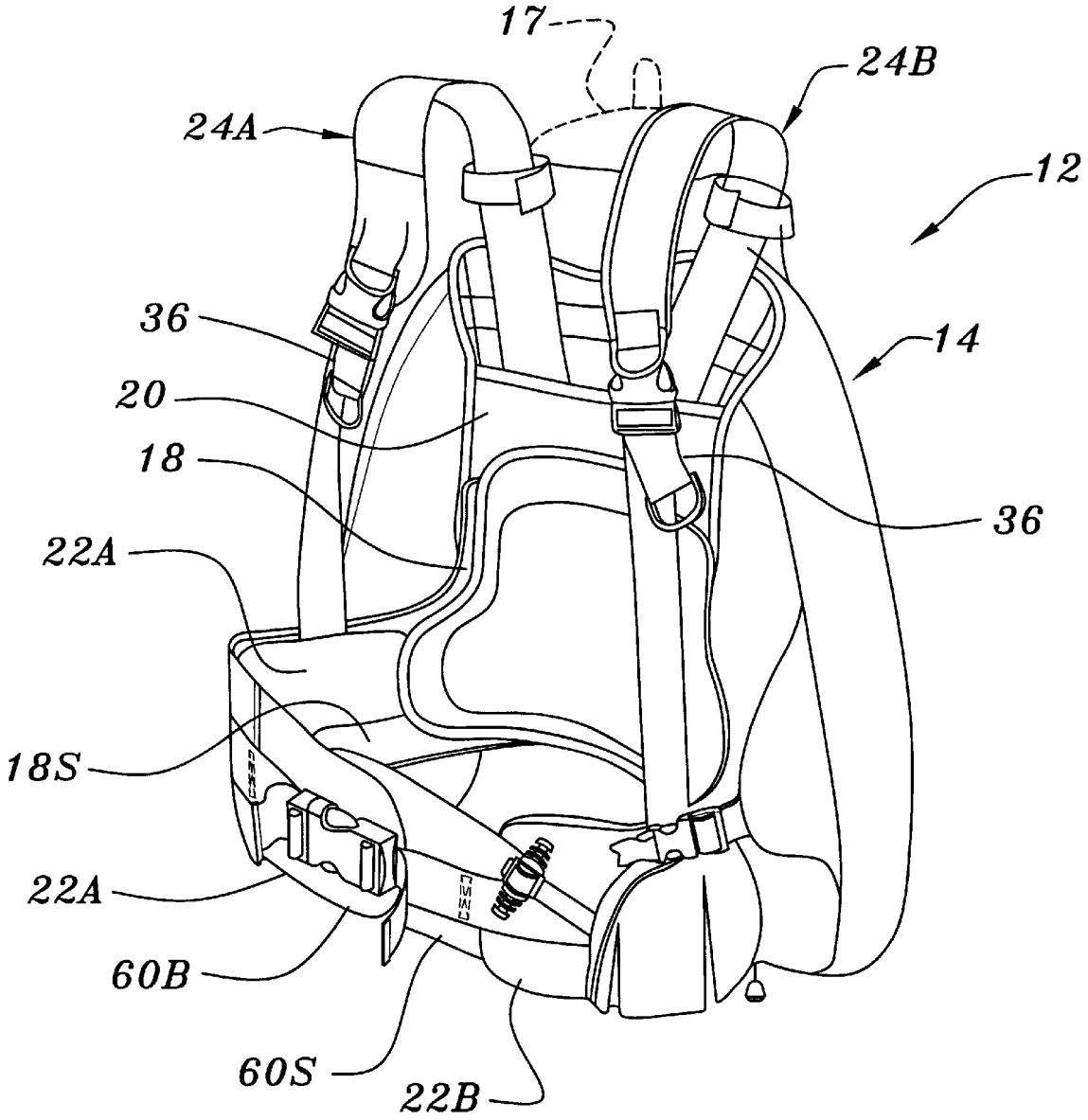
FIG. 1 is a perspective view of the buoyancy compensator of the invention.
Figure 1A:
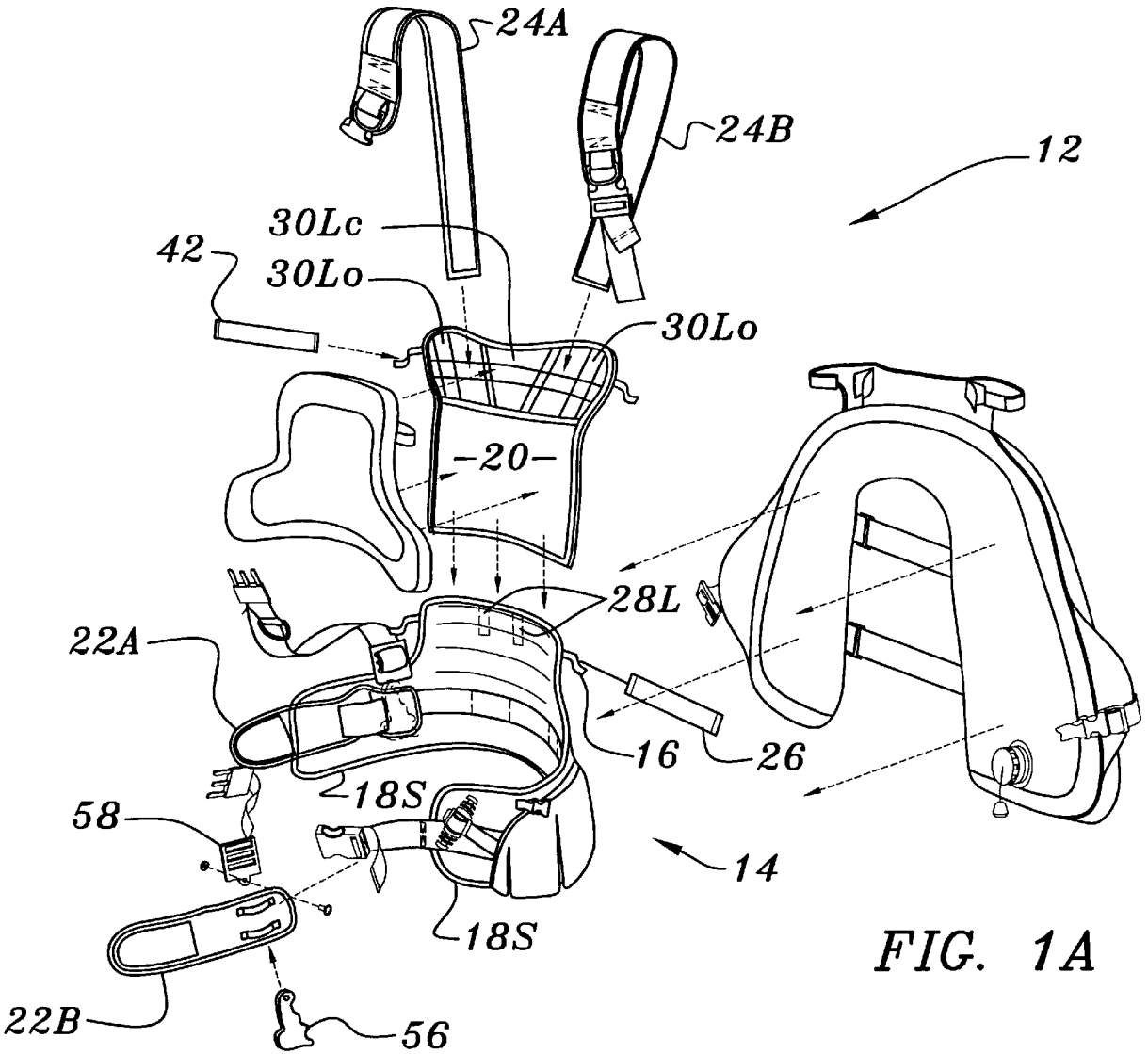
FIG. 1A is a partially exploded view of FIG. 1.
Figure 2:
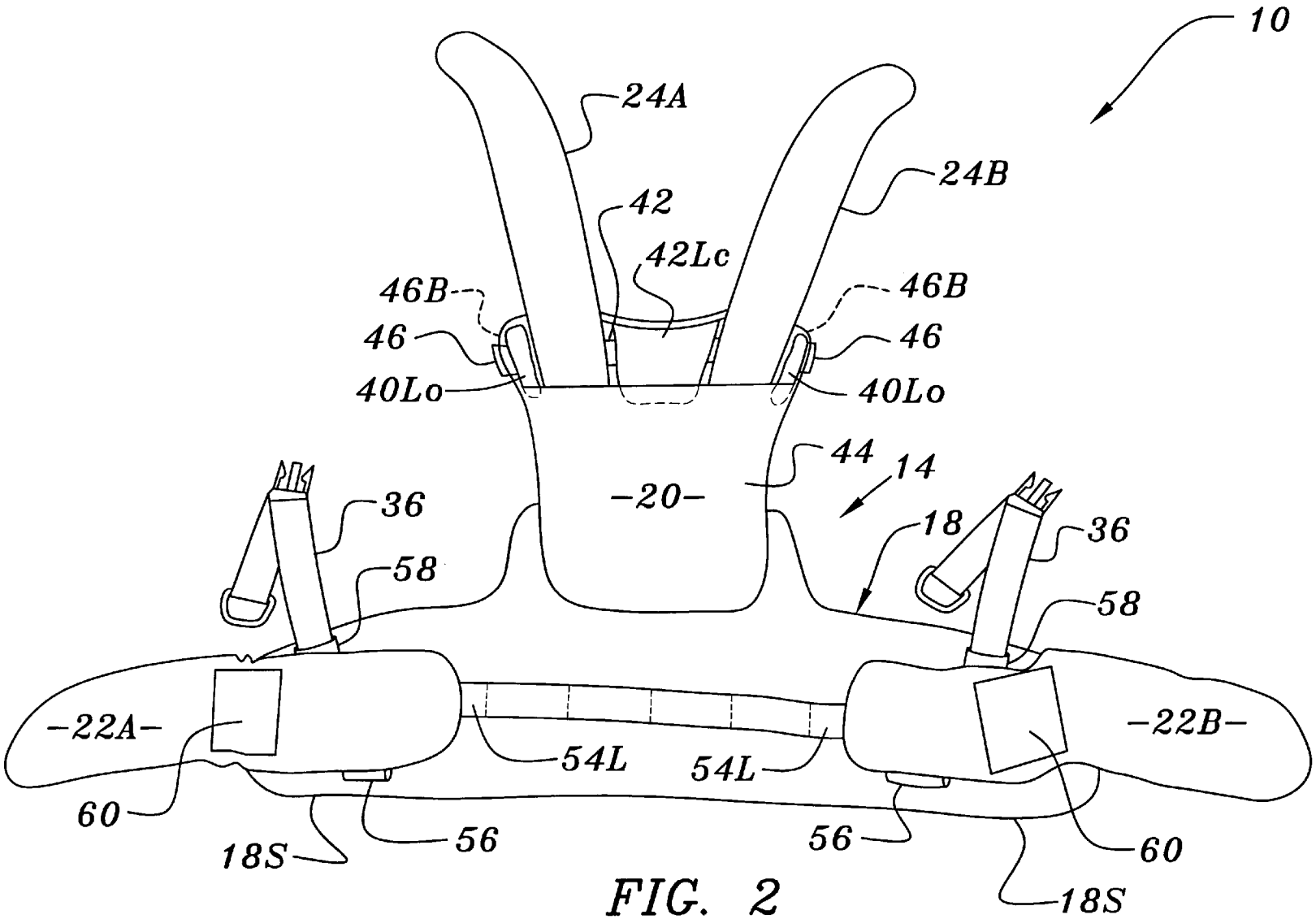
FIG. 2 is a plan view of the inside of the buoyancy compensator showing the various adjustable sections thereof.

Referring to FIGS. 1 and 2, the buoyancy compensator 10 of the invention comprises a conventional horseshoe-shaped bladder assembly 12 connected to a vest 14 by means of a pair of tank straps 16 which rigidly secures an air cylinder 17 to the vest 14 in a backpack-styled configuration. The vest 14 comprises a back section 18 (having a generally rectangular configuration with side portions 18S) to which is adjustably connected a torso section 20 and a pair of waistband sections 22A and 22B. The buoyancy compensator 10 of the invention further includes a pair of shoulder sections 24A and 24B adjustably connected to the torso section 20 of the vest 14. The various sections of the buoyancy compensator 10 of the invention are described separately as follows:

Torso Section

The torso section 10 of the invention comprises a generally rectangular configuration having an elongated vertical height and horizontal width (approximately equal or slightly less than the width of the upper portion of the back section 18 of the vest 14). Means are provided for vertically adjustably connecting the torso section 20 of the back section 18 such that the overall vertical height of the vest 14 may be increased or decreased to accommodate divers' torsos of increased or decreased height, respectively. The torso adjustment means may comprise a variety of conventional fasteners such as threaded fasteners, hook and loop fasteners, snaps, and straps and buckles.

Figure 3:
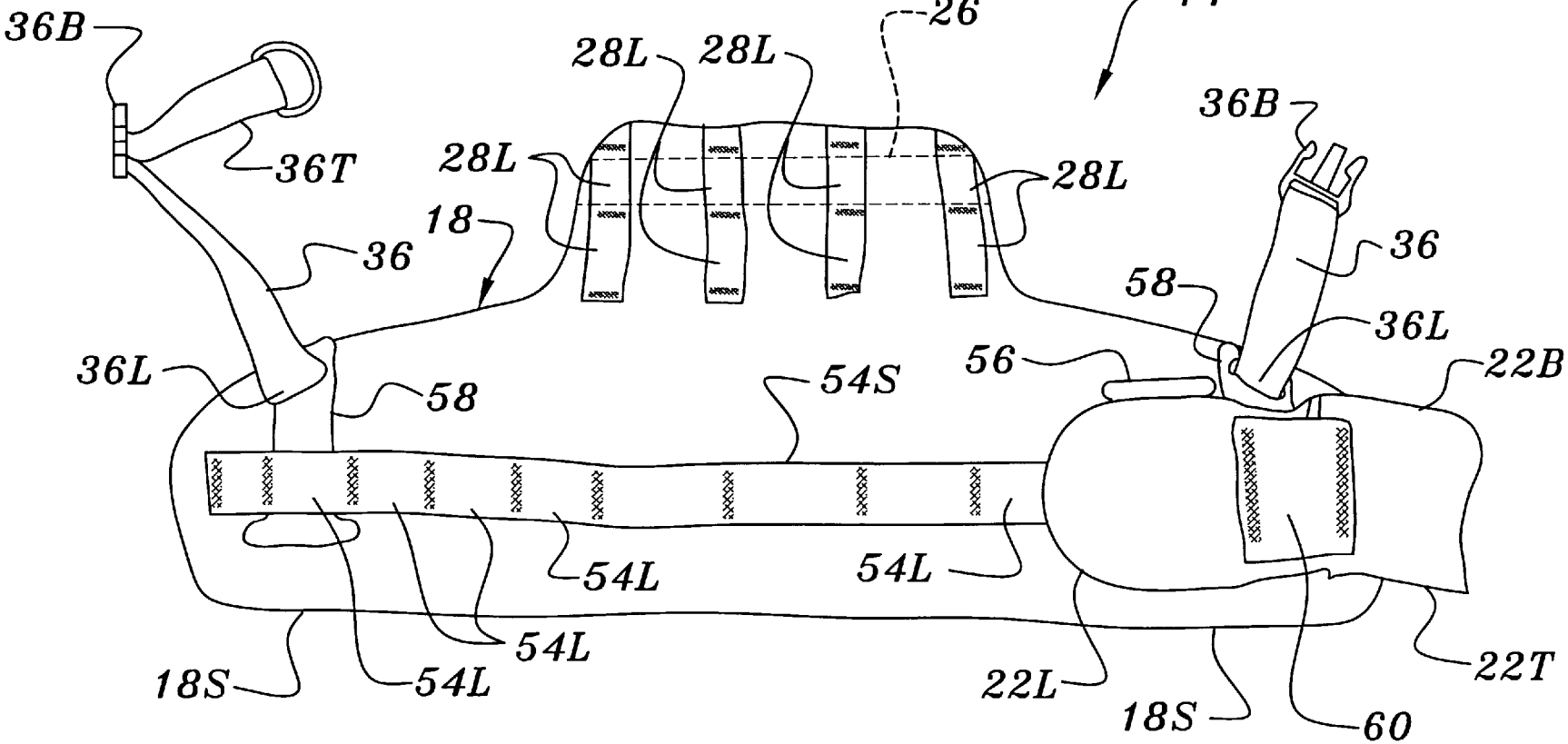
FIG. 3 is a plan view of the inside of the back section with the left waistband section installed.
Figure 4:
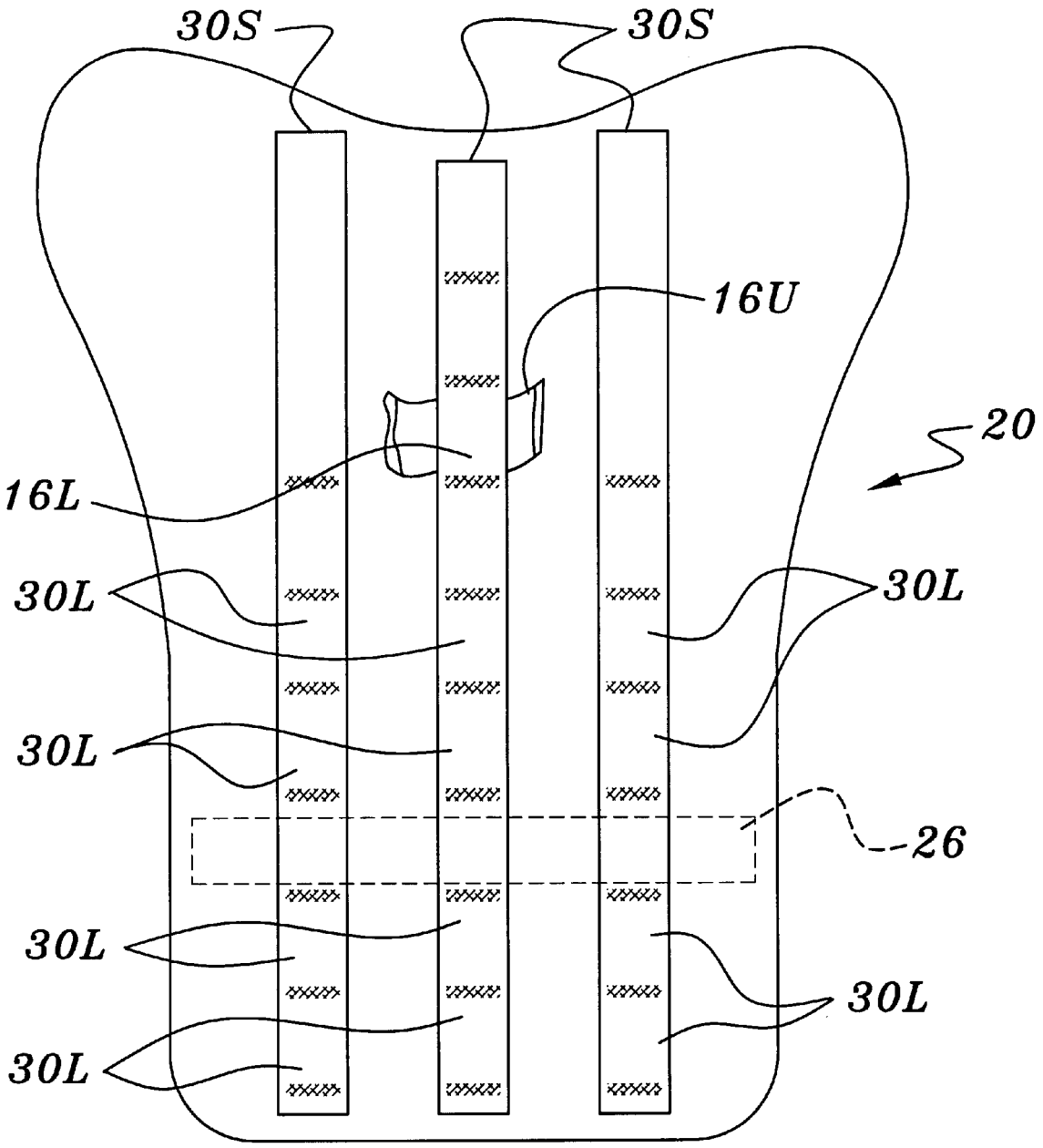
FIG. 4 is a plan view of the outside of the torso section.

Preferably, however, as shown in FIGS. 3 and 4, the adjustment means comprises a removable slat 26 which is dimensioned and configured to weave into a plurality of loops 28L sewn to the inside of the back section 12 and a plurality of loops 30L sewn on the outside of the torso section 20. More specifically, as shown in FIG. 3, the inside of the back section 18 of the vest 14 comprises a plurality of horizontal rows of loops 28L. Correspondingly, as shown in FIG. 4, the outside of the torso section 12 comprises a plurality of horizontal rows of loops 30L. The loops 28L and 30L are preferably found by sewing a plurality of straps 28S and 30S of webbing vertically to the back section 18 and torso section 20, respectively, in a spaced-apart configuration such that the straps 28S of the back section 18 are positioned between, and do not overlie, the straps 28S of the torso section 20 when the torso section 20 is positioned adjacent to the back section 18.

In this manner, the rows of loops 28L of the back section 18 may be aligned with the rows of the loops 30L of the torso section 20. While the respective loops 28L and 30L are in alignment, the slat 26 may be weaved therethrough such that the torso section 20 is rigidly secured to the back section 18. Moreover, it should be readily appreciated that the torso section 20 may be shifted vertically upwardly or downwardly relative to the back section 28 with the same or another horizontal row of loops 30L of the torso section 20 being in alternative alignment with the same or another row of loops 28L of the back section 18, thereby assuring the wide latitude of vertical adjustment. The maximum length of adjustability is attained when the torso section 20 is adjusted to a maximum torso length by aligning the bottommost horizontal row of loops 30L with the uppermost horizontal row of loops 28L of the back section 18. Conversely, a minimum torso length can be achieved by aligning the uppermost horizontal row of loops 30L of the torso section 20 with the lowermost horizontal row of loops 28L of the back section 18.

It is noted that the upper tank strap 16U may be secured to the torso section 20 by sewing the center strap 30S with another loop 16L for receiving the tank strap 16 therein. The lower tank strap 16 is affixed to the outside of the back section 18 in the conventional manner.

Shoulder Sections

Figure 5:
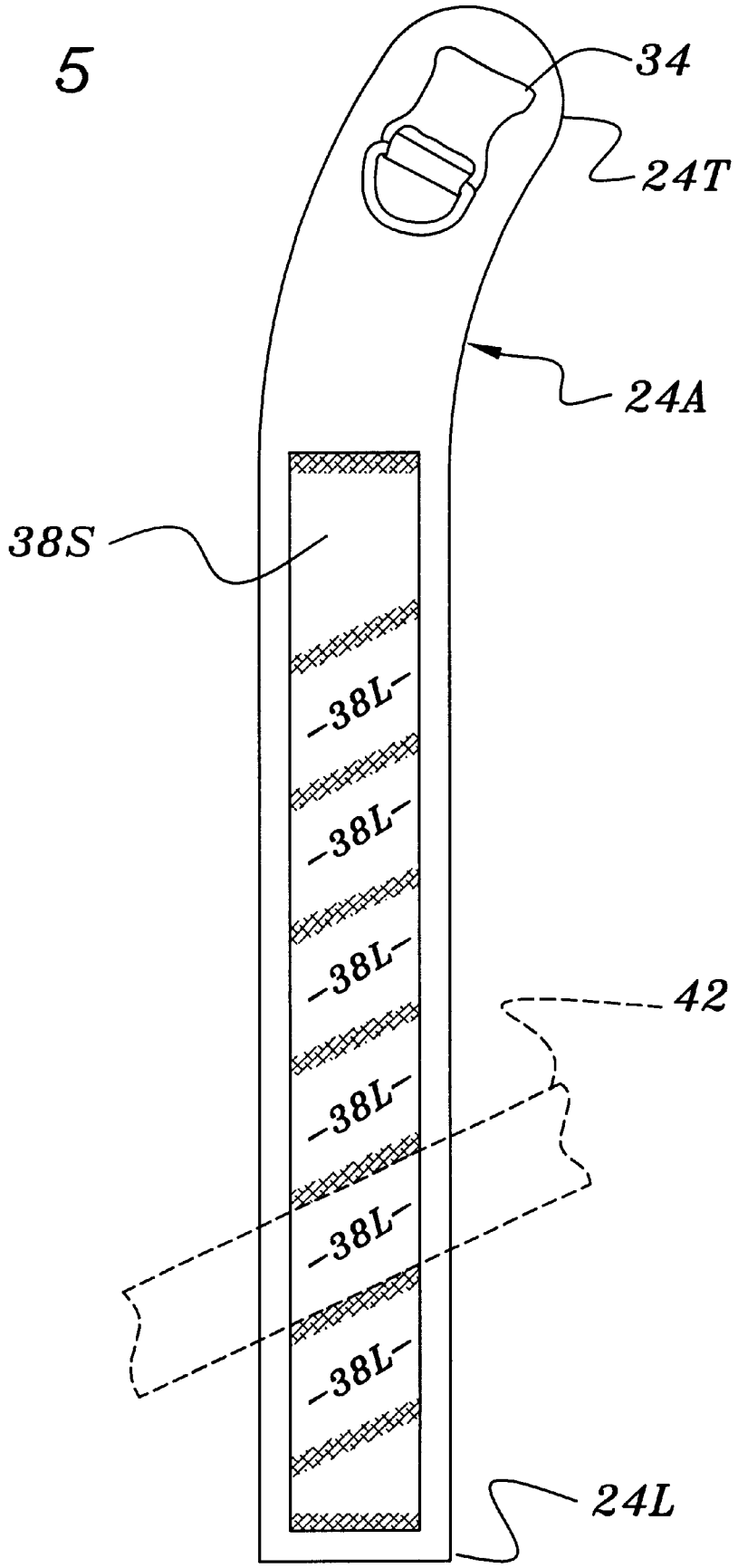
FIG. 5 is a plan view of the outside of the right shoulder section.
Figure 6:
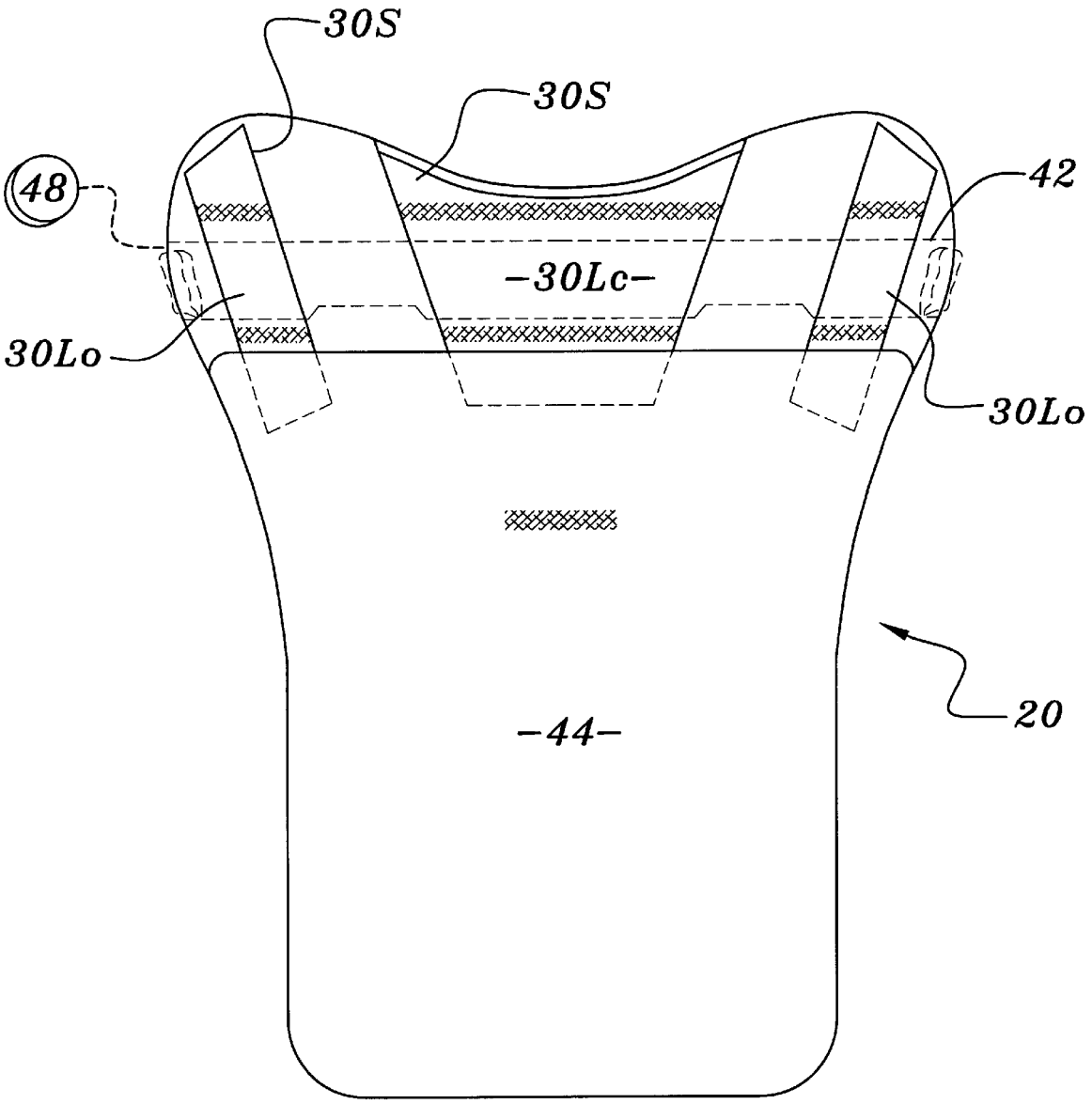
FIG. 6 is a plan view of the inside of the torso section.
Figure 7:
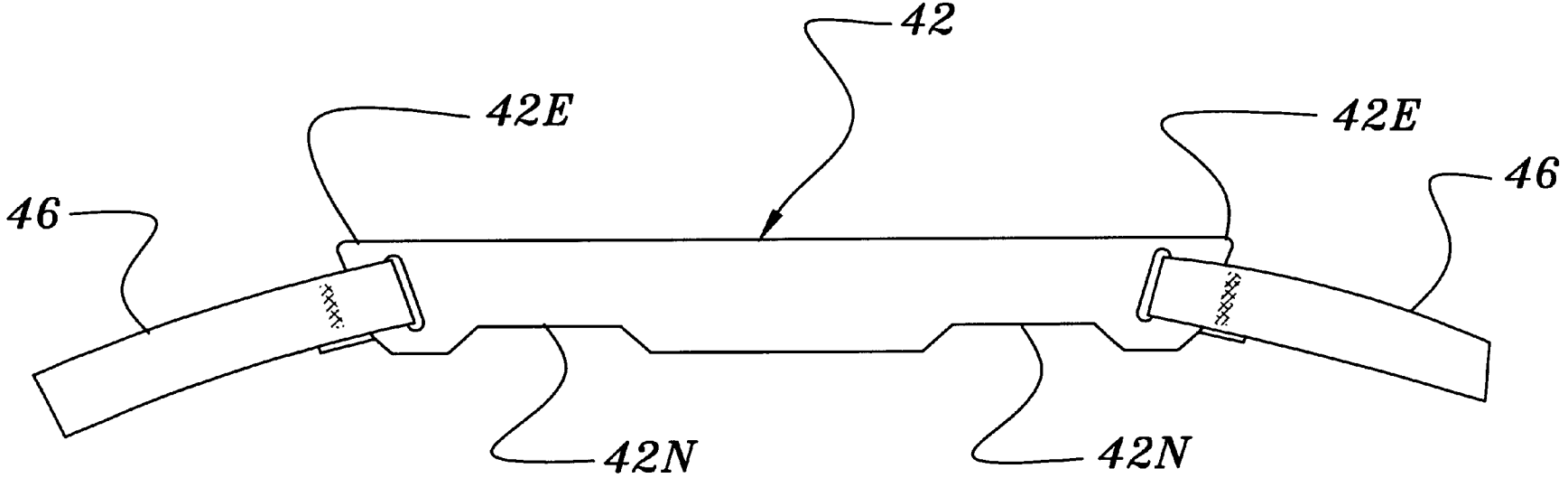
FIG. 7 is a plan view of the shoulder slat.

As shown in FIGS. 5–7, the shoulder sections 24A and 24B comprise a generally elongated design with a conventional buckle 34 sewn to its trailing end 24T to which may be buckled a conventional shoulder strap 36. Means are provided for vertically adjustably connecting the shoulder sections 24A and 4B to the torso section 20 such that the overall length of the shoulder sections 24A and 24B may be increased or decreased to accommodate differently-sized chests of divers. The shoulder adjustment means may comprise a variety of conventional fasteners such as threaded fasteners, hook and loop fasteners, snaps, and straps and buckles.

Preferably, however, the shoulder adjustment means of each shoulder section 24A and 24B comprises a plurality of loops 38L formed on the outer surface thereof. Loops 38L are formed by sewing a strap 38S of webbing to the outer surface of the shoulder sections 24A and 24B. The torso section 20 correspondingly includes a row of loops 40L that are configured for allowing rigid connection of the shoulder sections 24A and 24B thereto by means of a slat 42. More particularly, the row of loops 40L include left and right outside loops $\mathbf{40L}_O$ and a wide center loop $\mathbf{40L}_C$. The distance between the center loop $\mathbf{40L}_C$ and the outside loops $\mathbf{40L}_O$ is appreciably greater than the width of the loops 38L formed on the shoulder sections 24A and 24B such that the loops 38L may be aligned with the loops 40L of the torso section 20 and the slat 42 weaved therethrough. It is noted that the inside surface of the torso section 20 preferably includes a pocket for receiving the leading end 24L of the shoulder sections 24A and 24B. Further, it is noted that preferably the loops 38L of the shoulder sections 24A and 24B are formed angularly outwardly relative to the center line of the torso section 20 such that the shoulder sections 24A and 24B will extend angularly outwardly from the center of the torso section 20 to lay more comfortably over the diver's shoulders.

During assembly, the leading end 34L of each of the shoulder sections straps 24A and 24B are inserted into the pocket 44 at a depth to shorten the effective length of the shoulder sections 24A and 24B. The slat 42 is then weaved into one of the loops 38L of the shoulder section 24A and then the loop 40L of the torso section 20 and then one of the loops 38L of the other shoulder section 24B, thereby rigidly securing the shoulder sections 24A and 24B to the torso section 20.

In order to assure that the slat 42 does not slip out of its position within the loops 38L and 40L, the slat 42 may include notches 42N aligned with the loops 38L of the shoulder sections 24A and 24B. Also, a strap 46 may be connected to one or both of the ends 42E of the slat 42 and coupled, by means of a buckle 48 on the outside of the torso section 20.

It should be appreciated that the adjustability of the shoulder sections 24A and 24B accommodates for larger or smaller chest sizes of scuba divers. The maximum and minimum lengths that may be achieved due to the adjustability of the shoulder sections 24A and 24B. More particularly, for use with a diver having the largest chest size, the shoulder straps 24A and 24B would be connected to the torso section 20 by aligning the lowermost loop 38L of each of the shoulder sections 24A and 24B closest to the leading end 24L with the loops 40L of the torso section and in the case of a diver with a smallest chest size, the loop 38L closest to the trailing end 24T of each of the shoulder sections 24A and 24B would be aligned with the loops 40L of the torso section 20.

Waistband Section

Figure 8:
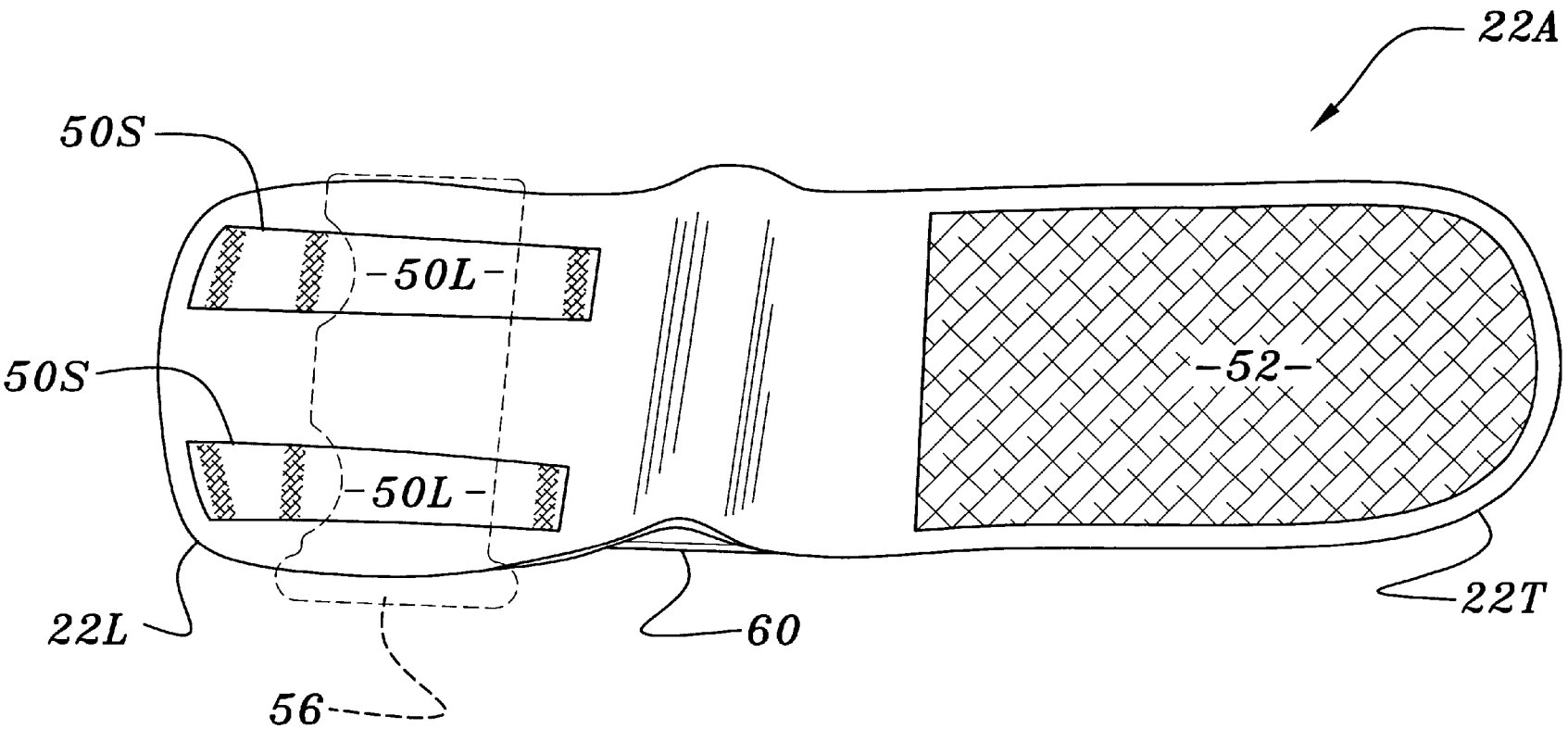
FIG. 8 is a plan view of the outside of the right waistband section.
Figure 10:
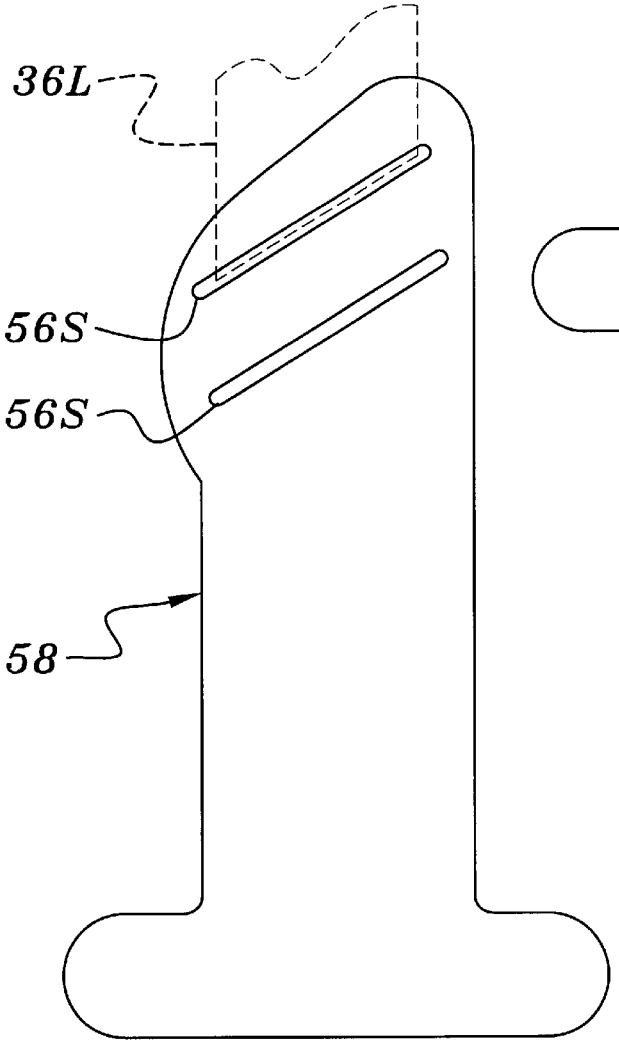
FIG. 10 is plan view of the shoulder strap slat.
Figure 9:
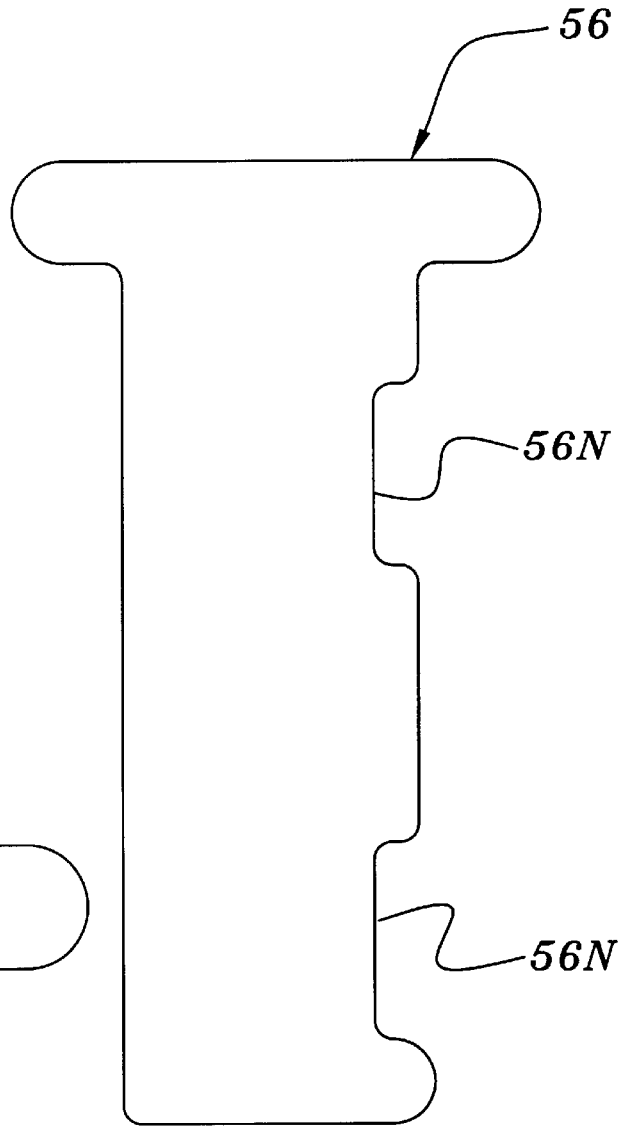
FIG. 9 is a plan view of the waistband slat.

As shown in FIGS. 8 and 9 in combination with FIGS. 2 and 3, the waistband sections 22A and 22B of the buoyancy compensator 10 of the invention each comprise an elongated configuration. Hook and loop fasteners 52 are sewn to the mating inside and outside surfaces of the trailing ends 22T of the waistband sections 22A and 22B as they are fitted over the diver's waist in an overlapping cummerbund fashion. Means are provided for adjustably connecting the waistband sections 22A and 22B to the back section 18 such that the overall length of the waistband sections 22A and 22B may be increased or decreased to accommodate differently-sized waists of divers. The waist adjustment means may comprise a variety of conventional fasteners such as threaded fasteners, hook and loop fasteners, snaps, and straps and buckles.

Preferably, however, the waist adjustment means comprises a pair of loops 50L formed on the outside of the leading end 22L for connection to the inside of the back section 18. Loops 50L are preferably formed by sewing a pair of spaced-apart straps 50S of webbing to the outside surface of the leading end 22L of each of the waistband sections 22A and 22B. Correspondingly, the back section 18 includes a plurality of loops 54L formed on the inside surface of the side portions 18S of the back section 18. Loops 50L are vertically disposed so as to vertically receive a slat 56 weaved therethrough when the loops 50L of the respective waistband section 20A or 20B is aligned with one of the loops 54L of the back section 18.

The slat 56 s preferably comprises a T-shaped configuration with strap notches 56N so that it is retained in its position weaved through the respective loops 50L and 54L. Another slat 58 comprising an inverted T-shaped configuration with its uppermost end containing slots 56S is provided to which is coupled the leading end 36L of the respective shoulder strap 36 instead of the leading end 36L of the shoulder strap 36 being sewn to the side portion 18S of the back section 18 as would be conventional in the art. In this manner, the shoulder straps 36 are adjustable so as to be properly fitted to the scuba diver despite the increased adjustment of the waistband sections 22A and 22B. It is noted that the slats 56 and 58 may be formed as a single slat without departing from the spirit and scope of this invention.

The maximum and minimum adjustability of the waistband sections 20A and 20B can be achieved by aligning the loops 50L of the waistband sections 20A and 20B with the outermost loop 54L of the back section 18 and with innermost loops 54L, respectively.

As noted above, the hook and loop fasteners 52 of the waistband sections 22A and 22B function as a cummerbund for comfortable wearing of the vest 14. Further, it is noted that a conventional elastic member 60 may be sewn onto the outside of each of the waistband sections 22A and 22B to provide for more comfortability of the vest 14 during use as the diver's waist sizes decreases upon descending to increased depths during diving. Finally, it is noted that a conventional waist strap 60S (see FIG. 1) may be sewn to the side portions of the back section 18 and provided with a buckle 60B for securing around the outside of the cummerbund created by the overlapping waistband sections 22A and 22B.

Figure 11:
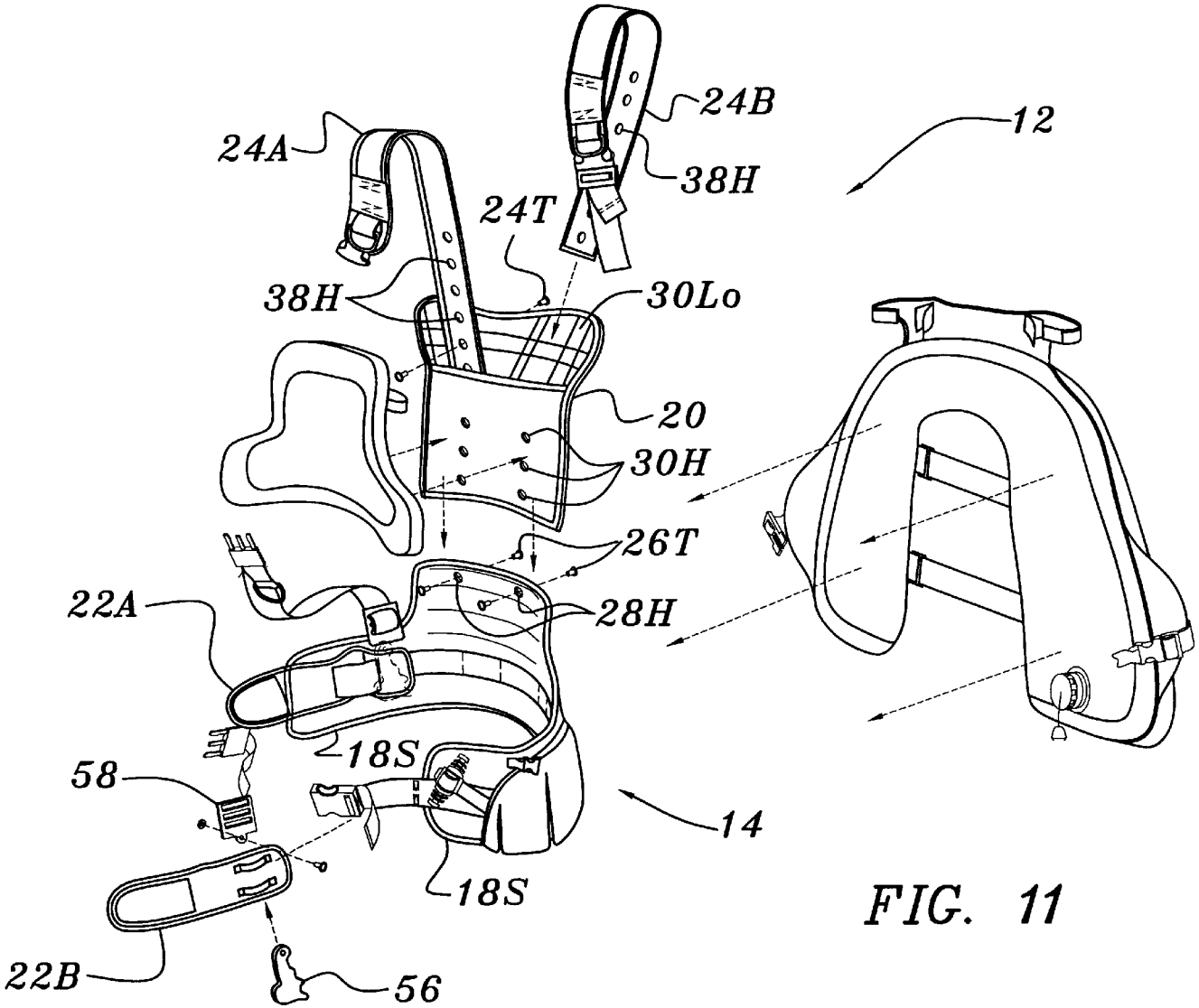
FIG. 11 is a partially exploded view of the of the buoyancy compensator of the invention wherein the torso and shoulder adjustment means comprise threaded fasteners.

As noted above, the torso, shoulder and waistband adjustment means may comprise a variety of conventional fasteners such as threaded fasteners, hook and loop fasteners, snaps, and straps and buckles. FIG. 11 illustrates the torso adjustment means as including threaded fasteners 26F that are inserted into corresponding holes 28T and 30T of the back section 18 and torso section 20, respectively, for interconnecting the same. Similarly, FIG. 11 illustrates the shoulder adjustment means as including threaded fasteners 42F that are inserted into corresponding holes 38F and 40F of the torso section 20 and shoulder section 24, respectively, for interconnecting the same.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A buoyancy compensator, comprising in combination:

a vest including left and right side portions, said vest further including a back section having a back section width, a torso section having a torso section width, left and right shoulder sections and left and right waistband sections, said back section width being at least as wide as said torso section width;

means for adjustably connecting said torso section to said back section with said torso section overlapping said back section such that said torso section is height-adjustable relative to said back section to allow fitting to torsos of various heights;

means for adjustably connecting said shoulder sections to said torso section; and means for adjustably connecting said waistband sections to respective side portions of said back section.

2. The buoyancy compensator as set forth in claim 1, wherein said means for adjustably connecting said torso section to said back section comprises at least one fastener interconnecting said torso section to said back section.

3. The buoyancy compensator as set forth in claim 2, wherein said fastener comprises a threaded fastener.

4. The buoyancy compensator as set forth in claim 2, wherein said means for adjustably connecting said torso section to said back section comprises a plurality of holes into which said fastener may be interconnected.

5. A buoyancy compensator, comprising in combination:

a vest including left and right side portions, said vest further including a back section, a torso section, left and right shoulder sections and left and right waistband sections;

means for adjustably connecting said torso section to said back section, said means for adjustably connecting said torso section to said back section comprising at least one loop connected to said back section, at least one loop connected to said torso section, and a torso slat weaved into said loops of said torso section and said back section;

means for adjustably connecting said shoulder sections to said torso section; and means for adjustably connecting said waistband sections to respective side portions of said back section.

6. The buoyancy compensator as set forth in claim 5, wherein said means for adjustably connecting said shoulder sections to said torso section comprises at least one fastener interconnecting said torso section to said back section.

7. The buoyancy compensator as set forth in claim 6, wherein said means for adjustably connecting said shoulder sections to said torso section comprises a plurality of holes into which said fastener may be interconnected.

8. A buoyancy compensator, comprising in combination:

a vest including left and right side portions, said vest further including a back section, a torso section, left and right shoulder sections and left and right waistband sections;

means for adjustably connecting said torso section to said back section;

means for adjustably connecting said shoulder sections to said torso section, said means for adjustably connecting said shoulder sections to said torso section comprising at least one loop connected to each said shoulder section, at least one respective loop connected to said torso section, and a shoulder slat weaved into said respective loops of said shoulder sections and said torso section; and means for adjustably connecting said waistband sections to respective side portions of said back section.

9. A buoyancy compensator, comprising in combination:

a vest including left and right side portions, said vest further including a back section, a torso section, left and right shoulder sections and left and right waistband sections;

means for adjustably connecting said torso section to said back section;

means for adjustably connecting said shoulder sections to said torso section; and means for adjustably connecting said waistband sections to respective side portions of said back section, said means for adjustably connecting said waistband sections to respective side portions of said back section comprising at least one loop connected to each said waistband section, at least one respective loop connected to respective said side portions of said back section, and a waistband slat weaved into said respective loops of said waistband sections and said side portions of said back section.

10. A buoyancy compensator, comprising in combination:

a vest including a back section and a torso section;

at least one row of loops connected to said back section;

at least one row of loops connected to said torso section; and a torso slat weaved into said loops of one of said rows of said torso section and of one of said rows of said back section.

11. A buoyancy compensator, comprising in combination:

a vest including a back section having a back section width and a torso section having a torso section width, said back section width being at least as wide as said torso section width, said torso section having an elongated vertical height;

at least one row of holes formed in said back section;

at least one row of holes formed in said torso section along said elongated vertical height; and a fastener interconnecting said holes of one of said rows of said torso section and of one of said rows of said back section with said torso section overlapping said back section such that said torso section is height-adjustable relative to said back section to allow fitting to torsos of various heights.

12. A buoyancy compensator, comprising in combination:

a vest including a back section, a torso section and a pair of shoulder sections;

at least one row of loops connected to said torso section;

at least one row of loops connected to each of said shoulder sections; and a shoulder slat weaved into said loops of one of said rows of said torso section and of one of said rows of each of said shoulder sections.

13. A buoyancy compensator, comprising in combination:

a vest including a back section with left and right side portions and a pair of waistband sections;

at least one column of loops connected to each of said left and right side portions of said torso section;

at least one column of loops connected to each of said waistband sections; and a waistband slat weaved into said loops of one of said columns of said torso section and one of said columns of each of said waistband sections.

* * * * *